US011785688B2

(12) United States Patent
Yang et al.

(10) Patent No.: US 11,785,688 B2
(45) Date of Patent: Oct. 10, 2023

(54) SOLID-STATE LIGHT EMITTER POWER SUPPLIES, DIMMABLE SOLID-STATE LIGHT SOURCES, AND METHOD OF POWERING SOLID-STATE LIGHT EMITTERS

(71) Applicant: LUMINII LLC, Niles, IL (US)

(72) Inventors: Meng Yang, Buffalo Grove, IL (US); Laszlo A. Takacs, Hayward, CA (US); Mina Nazari, Glenview, IL (US)

(73) Assignee: LUMINII LLC, Niles, IL (US)

( * ) Notice: Subject to any disclaimer, the term of this patent is extended or adjusted under 35 U.S.C. 154(b) by 0 days.

(21) Appl. No.: 17/744,869

(22) Filed: May 16, 2022

(65) Prior Publication Data

US 2022/0377861 A1 Nov. 24, 2022

Related U.S. Application Data

(60) Provisional application No. 63/189,034, filed on May 14, 2021.

(51) Int. Cl.

| | |
|---|---|
| ***H05B 45/30*** | (2020.01) |
| ***H05B 45/385*** | (2020.01) |
| ***H05B 45/325*** | (2020.01) |
| ***H05B 45/355*** | (2020.01) |
| ***H05B 45/10*** | (2020.01) |

(52) U.S. Cl.

CPC ..... *H05B 45/385* (2020.01); *H05B 45/10* (2020.01); *H05B 45/325* (2020.01); *H05B 45/355* (2020.01)

(58) Field of Classification Search

CPC ..... H05B 45/10; H05B 45/31; H05B 45/37; H05B 45/325; H05B 45/355; H05B 45/385; H05B 45/395

See application file for complete search history.

(56) References Cited

U.S. PATENT DOCUMENTS

| | | | | |
|---|---|---|---|---|
| 9,473,031 | B2 * | 10/2016 | Mao | H02M 3/33515 |
| 10,362,644 | B1 * | 7/2019 | Xiong | H05B 45/59 |
| 10,462,868 | B2 * | 10/2019 | Duan | H05B 45/397 |
| 2010/0244726 | A1 * | 9/2010 | Melanson | H05B 45/382 315/291 |

(Continued)

*Primary Examiner* — Tung X Le

(74) *Attorney, Agent, or Firm* — Saul Ewing LLP

(57) ABSTRACT

A solid-state light emitter power supply includes a first rectifier circuit, a second rectifier circuit, a power factor correction (PFC) stage, a first flyback converter, a second flyback converter, and a microcontroller. The rectifier circuits are configured to receive phase-cut signals from respective dimmer circuits as inputs and output respective phase-cut rectified power signals. The PFC stage is configured to receive a sum of the phase-cut rectified power signals as input and output a power-factor corrected electrical power to the flyback converters. The flyback converters are connected in parallel and are configured to power respective loads including a respective solid-state light emitter. The microcontroller is configured to receive signals derived from the phase-cut signals as inputs and to output respective pulse-width modulation (PWM) control signals to each of the flyback converters. Each flyback converter receives a respective power output portion of the power-factor corrected electrical power in accordance with the respective PWM control signals.

25 Claims, 9 Drawing Sheets

(56) References Cited

U.S. PATENT DOCUMENTS

2012/0056548 A1* 3/2012 Duan ..... H05B 45/385
323/299
2012/0188794 A1* 7/2012 Chang ..... H05B 45/3575
363/16

* cited by examiner

SOLID-STATE LIGHT EMITTER POWER SUPPLIES, DIMMABLE SOLID-STATE LIGHT SOURCES, AND METHOD OF POWERING SOLID-STATE LIGHT EMITTERS

CROSS-REFERENCE TO RELATED APPLICATIONS

This application is based on, and claims priority to, U.S. Provisional Application No. 63/189,034, filed on May 14, 2021, the entire contents of which being fully incorporated herein by reference.

BACKGROUND OF THE INVENTION

Dimmable power supplies are available to adjust the brightness of solid-state light emitters. Examples of solid-state light emitters are light-emitting diodes (LEDs), organic light-emitting diodes (OLEDs), and laser diodes. In some applications, a solid-state light emitter emits visible light such as white light, red light, green light, and blue light. In other applications, a solid-state light emitter emits non-visible light such as ultraviolet (UV) light including ultra-violet C (UVC) light. For example, suppose that a room has two solid-state light emitters and that each solid-state light emitter is powered by a respective mains power source. By use of a suitable dimmable power supply, each light emitter can be independently dimmed to a power level of less than 100% of the supply. However, it would not be possible to increase the brightness of one of the light emitters to a power level greater than 100%. A solid-state light emitter power supply that enables increasing the brightness of one or more of a plurality of light emitters to a power level greater than 100% would be desirable.

SUMMARY OF THE INVENTION

Solid-state light emitter power supplies, dimmable solid-state light sources, and methods of power solid-state light emitters are disclosed herein. In one aspect, a solid-state light emitter power supply includes: a first rectifier circuit couplable to a first dimmer circuit, a second rectifier circuit couplable to a second dimmer circuit, a power factor correction (PFC) stage coupled to the first rectifier circuit and to the second rectifier circuit, a first flyback converter, a second flyback converter, and a microcontroller. Each rectifier circuit is configured to receive a respective phase-cut signal from the respective dimmer circuit as input and output a respective phase-cut rectified power signal. The PFC stage is configured to receive a sum of the first phase-cut rectified power signal and the second phase-cut rectified power signal as input and output a power-factor corrected electrical power. The input circuits of the flyback converters are coupled to the PFC stage. The input circuits of the flyback converters are connected to the PFC stage in parallel. The output circuits of the flyback converters are configured to power a respective load including a respective solid-state light emitter. The microcontroller is configured to receive signals derived from the phase-cut signals (phase-cut derived signals) as inputs and output respective pulse-width modulation (PWM) control signals to the respective flyback input circuits in accordance with respective power output portions. Each respective flyback input circuit receives a respective power output portion of the power-factor corrected electrical power in accordance with the respective PWM control signal. The microcontroller calculates the respective power output portions in accordance with the respective phase-cut derived signals.

In another aspect, a dimmable solid-state light source includes a first load including a first solid-state light emitter, a second load including a second solid-state light emitter, and a solid-state light emitter power supply. The solid-state light emitter power supply powers the first load and the second load.

In yet another aspect, a method of powering solid-state light emitters includes the following. Each one of a plurality of rectifier circuits (numbered 1 through N) receives a respective phase-cut signal from a respective dimmer circuit as input. Each rectifier circuit outputs a respective phase-cut rectified power signal. A power factor correction (PFC) stage receives a sum of the phase-cut rectified power signals as input. The PFC stage outputs a power-factor corrected electrical power to flyback converters (numbering 1 through N). Each respective flyback converter includes a respective flyback input circuit and a respective flyback output circuit. Each respective flyback input circuit is coupled to the PFC stage and each respective flyback output circuit is coupled to a respective load including a respective solid-state light emitter. The flyback input circuits are connected to the PFC stage in parallel. A microcontroller receives respective phase-cut derived signals as inputs, each of which is derived from the respective phase-cut signal. The microcontroller calculates each respective power output portion $P_i$ (i ranges from 1 through N) in accordance with the respective phase-cut derived signals. The microcontroller outputs a respective pulse-width modulation (PWM) control signal to each respective flyback input circuit in accordance with the respective power output portion $P_i$. Each respective flyback input circuit receives the respective portion $P_i$, of the power-factor corrected electrical power in accordance with the respective PWM control signal. Each respective flyback output circuit powers the respective load.

The above summary of the present invention is not intended to describe each disclosed embodiment or every implementation of the present invention. The description that follows more particularly exemplifies illustrative embodiments. In several places throughout the application, guidance is provided through examples, which examples can be used in various combinations. In each instance of a list, the recited list serves only as a representative group and should not be interpreted as an exclusive list.

BRIEF DESCRIPTION OF THE FIGURES

The disclosure may be more completely understood in consideration of the following detailed description of various embodiments of the disclosure in connection with the accompanying drawings, in which.

DETAILED DESCRIPTION OF ILLUSTRATIVE EMBODIMENTS

The present disclosure relates to solid-state light emitter power supplies, dimmable solid-state light sources, and a method of powering solid-state light emitters.

In this disclosure:

The words "preferred" and "preferably" refer to embodiments of the invention that may afford certain benefits, under certain circumstances. However, other embodiments may also be preferred, under the same or other circumstances. Furthermore, the recitation of one or more preferred embodiments does not imply that other embodiments are not useful and is not intended to exclude other embodiments from the scope of the invention.

The terms "comprises" and variations thereof do not have a limiting meaning where these terms appear in the description and claims.

Unless otherwise specified, "a," "an," "the," and "at least one" are used interchangeably and mean one or more than one.

The recitations of numerical ranges by endpoints include all numbers subsumed within that range (e.g., 1 to 5 includes 1, 1.5, 2, 2.75, 3, 3.80, 4, 5, etc.).

For any method disclosed herein that includes discrete steps, the steps may be conducted in any feasible order. As appropriate, any combination of two or more steps may be conducted simultaneously.

Figure 1:
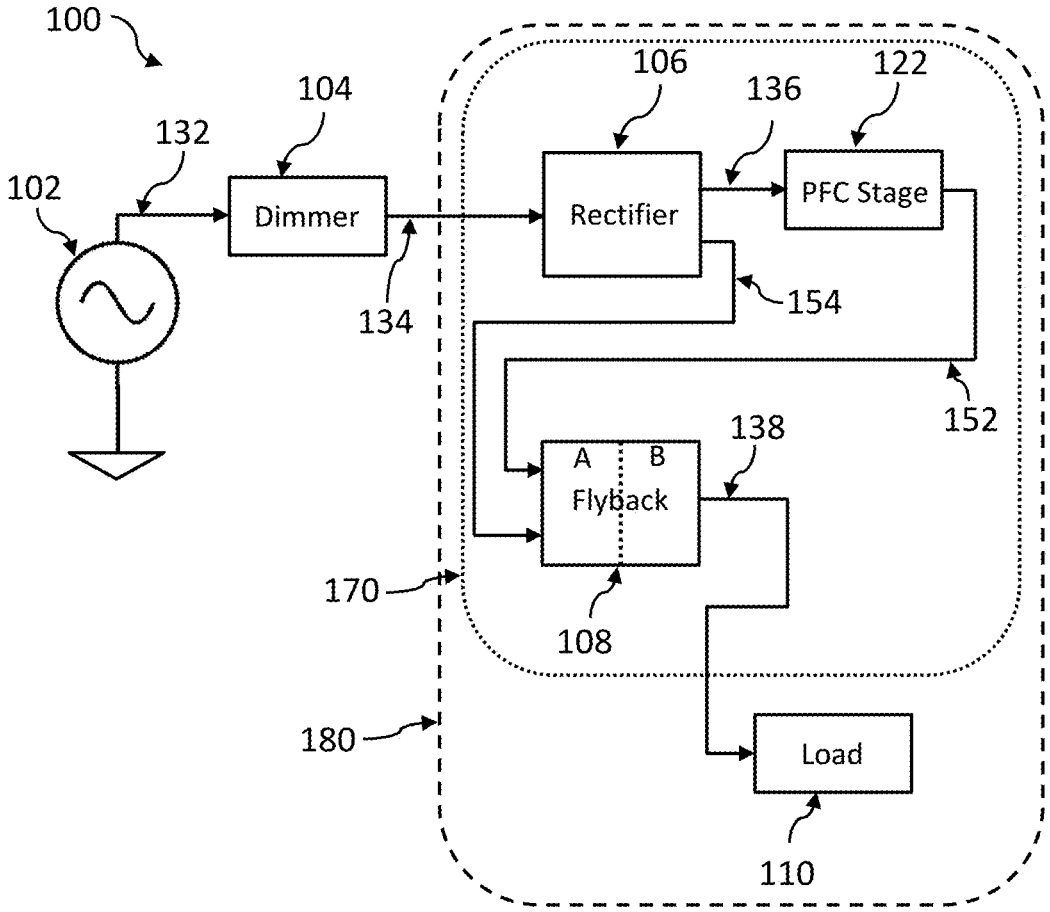
FIG. 1 is a schematic block diagram of an implementation of a dimmable solid-state light source.

FIG. 1 is a schematic block diagram of an implementation 100 of a solid-state light source. An alternating current (AC) mains power source 102 supplies mains power 132 to a dimmer circuit 104. A dimmer circuit is a circuit that enables dimming of a light output from a light emitter by changing the voltage waveform of the power signal applied to the light emitter. Typically, the dimmer circuit switches on at an adjustable time (adjustable phase angle) after the start of each half-cycle in the AC input power (mains power 132). The phase angle adjustment is carried out in accordance with a dimming input (e.g., a user input entered through a dimmer switch of the dimmer circuit). When a larger phase angle is cut from the input power, the effective voltage (the root mean square (RMS) voltage) is reduced. The dimmer circuit 104 receives the mains power 132 and the dimming input and outputs a phase-cut signal 134 in accordance with the dimming input.

In the example shown, rectifier circuit 106 is coupled to the dimmer circuit 104. A rectifier circuit converts an alternating current (AC) waveform to a direct current (DC) waveform (e.g., current flowing in one direction only). The rectifier circuit 106 is configured to receive the phase-cut signal 134 from the dimmer circuit 104 as input and output a phase-cut rectified power signal 136. A power factor correction (PFC) stage 122 is coupled to the rectifier circuit 106. The power factor PF is defined as a ratio of real power (RP) to apparent power (AP) in a circuit, where the RP is the average, over a cycle, of the instantaneous product of current and voltage (expressed in Watts), and the AP is the product of the RMS value of the current and the RMS value of the voltage (expressed in V A). For a given amount of useful power transferred to a load, a lower power-factor circuit draws more current than a higher power-factor circuit. Accordingly, in order to improve the efficiency of a circuit, it is preferable to use a PFC stage. The PFC stage 122 is configured to receive the phase-cut rectified power signal 136 and output a power-factor corrected electrical power 152. Herein, an electrical power signal output (e.g., 152) by a PFC stage is said to be power-factor corrected when its power factor is greater than that of the electrical power signal (e.g., 136) that the PFC stage receives as input.

A flyback converter can be a switching converter with galvanic isolation. In the examples shown herein, the flyback converters are in a step-down configuration. Flyback converter 108 includes a flyback input circuit 108A (primary circuit) and a flyback output circuit 108B (secondary circuit). The flyback input circuit 108A is coupled to the PFC stage 122 and the flyback output circuit 108B is configured to power a load 110 which includes a solid-state light emitter. A switch of the flyback input circuit 108A is closed or opened in response to a pulse-width modulation (PWM) control signal. In the implementation 100 of FIG. 1, a phase-cut derived signal 154 from the rectifier circuit 106 is used as this PWM control signal. When the switch of the flyback input circuit is closed, the primary of the flyback transformer is connected to the power signal (power-factor corrected electrical power 152). Accordingly, energy is stored in the flyback transformer. The energy stored in the flyback transformer is proportional to the duty cycle of the PWM control signal (154). The flyback output circuit 108B supplies this stored energy to the load 110.

If a room or office where a dimmable solid-state light source is to be installed has a mains power source 102 and a dimmer circuit 104 already installed, there is no need for a dimmable solid-state light source to include a dimmer circuit 104. In this case, a dimmable solid-state light source may need the elements enclosed within region 180 (e.g., rectifier circuit 106, PFC stage 122, flyback converter 108, and load 110) but may not need a dimmer circuit 104. Similarly, a solid-state light emitter power supply may need the elements enclosed within region 170 (e.g., rectifier circuit 106, PFC stage 122, and flyback converter 108) but may not need a dimmer circuit 104.

Figure 2:
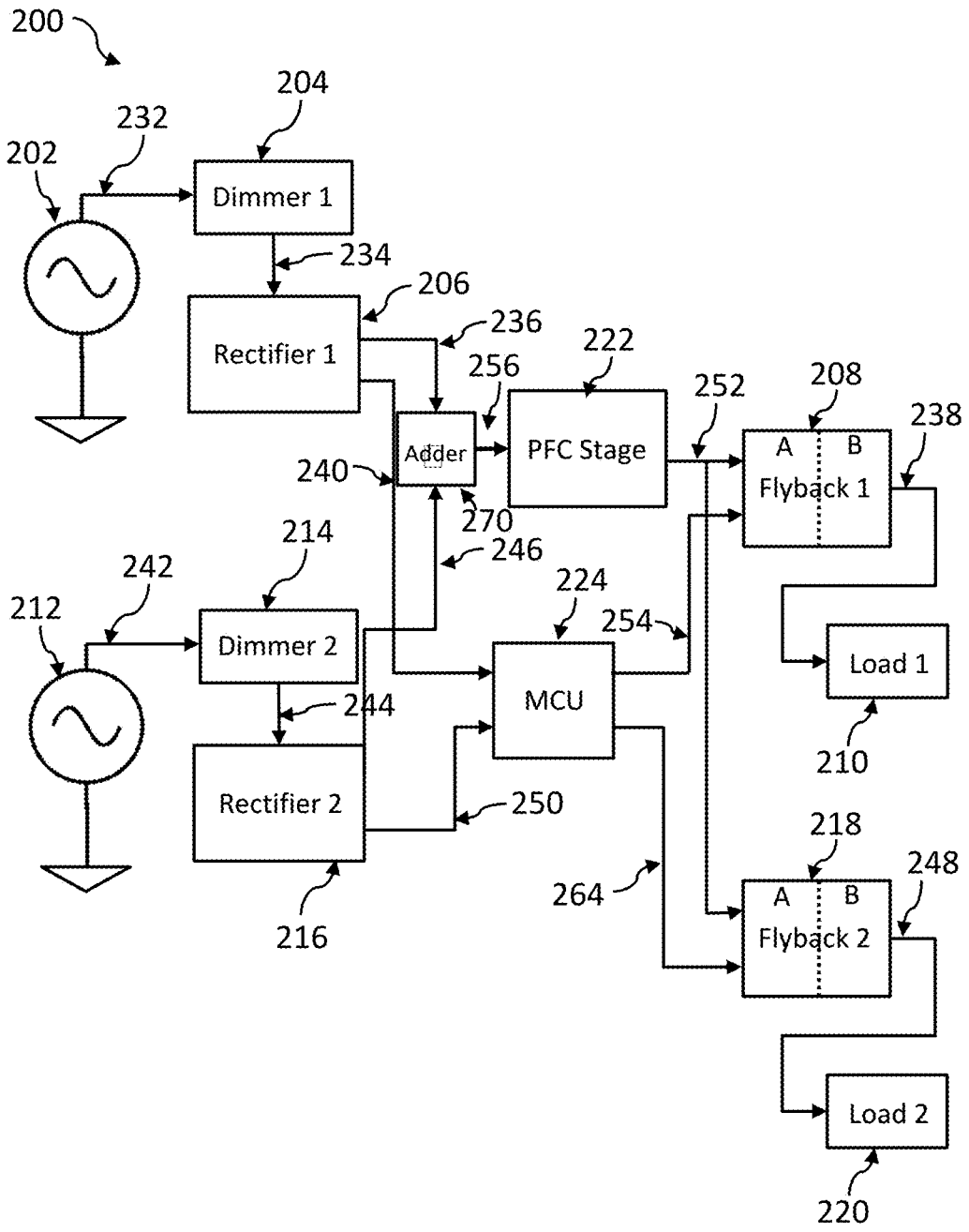
FIG. 2 is a schematic block diagram of an implementation of a dimmable solid-state light source including two loads.

FIG. 2 is a schematic block diagram of an implementation 200 of a solid-state light source that includes two loads. A first mains power source 202 supplies first mains power 232 to a first dimmer circuit 204 and a second mains power source 212 supplies second mains power 242 to a second dimmer circuit 214. The first dimmer circuit 204 is configured to: receive first mains power 232, receive a first dimming input, and output a first phase-cut signal 234 in accordance with the first dimming input. The second dimmer circuit 214 is configured to: receive second mains power 242, receive a second dimming input, and output a second phase-cut signal 244 in accordance with the second dimming input. In the example shown, a first rectifier circuit 206 and a second rectifier circuit 216 are respectively coupled to the first dimmer circuit 204 and to the second dimmer circuit 214. The first rectifier circuit 206 is configured to receive a first phase-cut signal 234 from the first dimmer circuit 204 as input and output a first phase-cut rectified power signal 236. The second rectifier circuit 216 is configured to receive a second phase-cut signal 244 from the second dimmer circuit 214 as input and output a second phase-cut rectified power signal 246.

A PFC stage 222 is coupled to the first rectifier circuit 206 and to the second rectifier circuit 216. The PFC stage 222 is configured to receive a sum 256 of the first phase-cut rectified power signal 236 and the second phase-cut rectified power signal 246 as input (e.g., via an adder 270) and output a power-factor corrected electrical power 252. A first flyback converter 208 includes a first flyback input circuit 208A and a first flyback output circuit 208B. A second flyback converter 218 includes a second flyback input circuit 218A and a second flyback output circuit 218B. The first flyback input circuit 208A and the second flyback input circuit 218A are coupled to the PFC stage 222. The first flyback input circuit 208A and the second flyback input circuit 218A are connected to the PFC stage 222 in parallel. The first flyback output circuit 208B is configured to supply a first power output 238. The second flyback output circuit 208B is configured to supply a second power output 248. The first flyback output circuit 208B is configured to power a first load 210 including a first solid-state light emitter. The second flyback output circuit 218B is configured to power a second load 220 including a second solid-state light emitter.

A microcontroller (MCU) 224 is configured to receive a first phase-cut derived signal 240 and a second phase-cut derived signal 250 as inputs. The first phase-cut derived signal 240 is derived from the first phase-cut signal 234 and the second phase-cut derived signal 250 is derived from the second phase-cut signal 244. In FIG. 2, the first phase-cut derived signal 240 can be a voltage signal proportional to the first phase-cut rectified power signal 236, which is derived from the first phase-cut signal 234, and the second phase-cut derived signal 250 can be a voltage signal proportional to the second phase-cut rectified power signal 246, which is derived from the second phase-cut signal 244.

The microcontroller 224 calculates a first power output portion $P_1$ and a second power output portion $P_2$ in accordance with the first phase-cut derived signal 240 and the second phase-cut derived signal 250. The microcontroller 224 is configured to output a first pulse-width modulation (PWM) control signal 254 to the first flyback input circuit 208A in accordance with the first power output portion $P_1$ and a second PWM control signal 264 to the second flyback input circuit 218A in accordance with the second output portion $P_2$. The first flyback input circuit 208A receives the first power output portion $P_1$ of the power-factor corrected electrical power 252 in accordance with the first PWM control signal 254 and the second flyback input circuit 218A receives the second output portion $P_2$ of the power-factor corrected electrical power 252 in accordance with the second PWM control signal 264.

Figure 4:
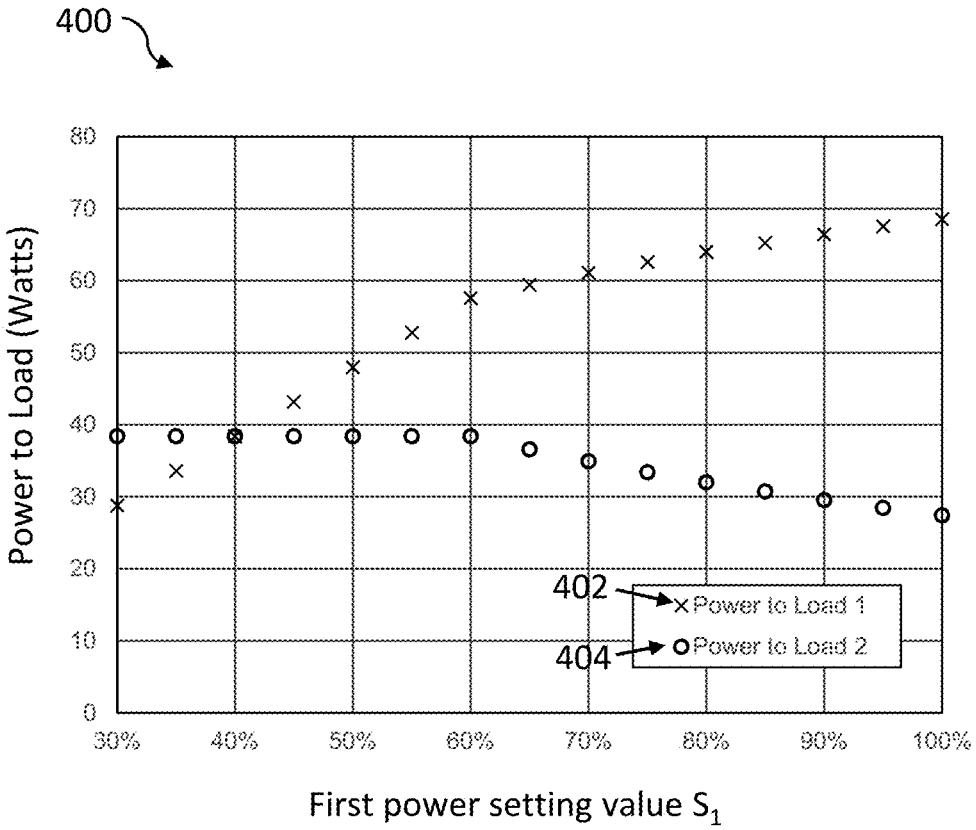
FIG. 4 is a graphical plot of a dependence of power output to a first load and a second load on a first power setting value $S_1$ when a second power setting value $S_2$ is set at 40%.

An example of apportioning output portions $P_1$ and $P_2$ is shown by reference to FIG. 2 and FIG. 4. The first phase-cut derived signal 240 indicates a first power setting value $S_1$ and the second phase-cut derived signal 250 indicates a second power setting value $S_2$. The first power setting value $S_1$ corresponds to a first dimming input, received at the first dimmer circuit 204. The second power setting value $S_2$ corresponds to a second dimming input, received at the second dimmer circuit 214. A relationship among $S_1$, $S_2$, $P_1$, and $P_2$ can be expressed by the following Equations 1, 2, 3, and 4:

$$P_1=S_1 \text{ when a sum } S_1+S_2<100\% \quad (1);$$

$$P_2=S_2 \text{ when the sum } S_1+S_2<100\% \quad (2);$$

$$P_1 = \frac{S_1}{S_1 + S_2},$$

when the sum $S_1+S_2\geq 100\%$ (Eq. 3); and $$P_2 = \frac{S_2}{S_1 + S_2},$$

when the sum $S_1+S_2\geq 100\%$ (Eq. 4).

FIG. 4 is a graphical plot 400 showing the dependence of the power 402 supplied to the first load 210 (shown as x's) and the power 404 supplied to the second load 220 (shown as circles) on the first power setting value $S_1$. The first power setting value $S_1$ is varied between 30% and 100%. The second power setting value $S_2$ is held at 40%. In this example, we limit the total power available to be supplied to the two loads (210, 220) to be 96 W, since power from two mains power sources (202, 212) are being added (48 W×2). For the first power setting value $S_1$ in a range of 30% to 60%, $S_1+S_2<100\%$ and Equations 1 and 2 are applicable. According to Equations 1 and 2, the respective power output portions $P_1$ and $P_2$ are approximately equal to the respective power setting values $S_1$ and $S_1$. For the first power setting value $S_1$ in a range of 30% to 60%, the power 404 to the second load 220 is held constant around 38.4 W (96 W×40%) and the power 402 to the first load 210 increases according to $P_1=S_1$. For the first power setting value $S_1$ in a range of 60% to 100%, $S_1+S_2\geq 100\%$ and Equations 3 and 4 are applicable. According to Equations 3 and 4, the power 404 to the second load 220 decreases and the power 402 to the first load 210 increases with increasing $S_1$. This has the effect of "reapportioning" some of the power previously available to the second load (for $S_1<60\%$) to the first load.

Figure 5:
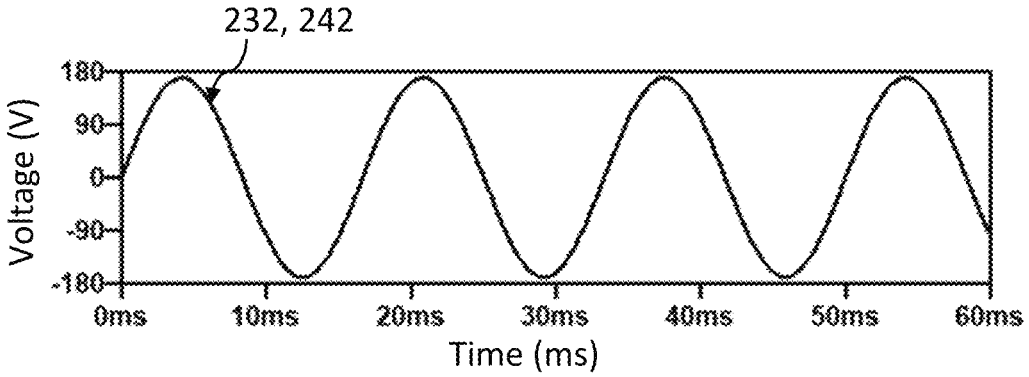
FIG. 5 is a graphical plot of a mains power waveform.
Figure 6:
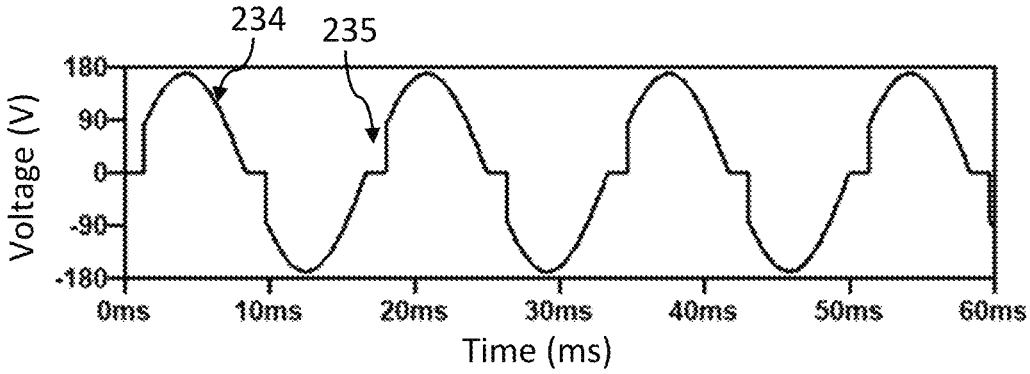
FIGS. 6 and 7 are graphical plots of phase-cut signals.
Figure 7:
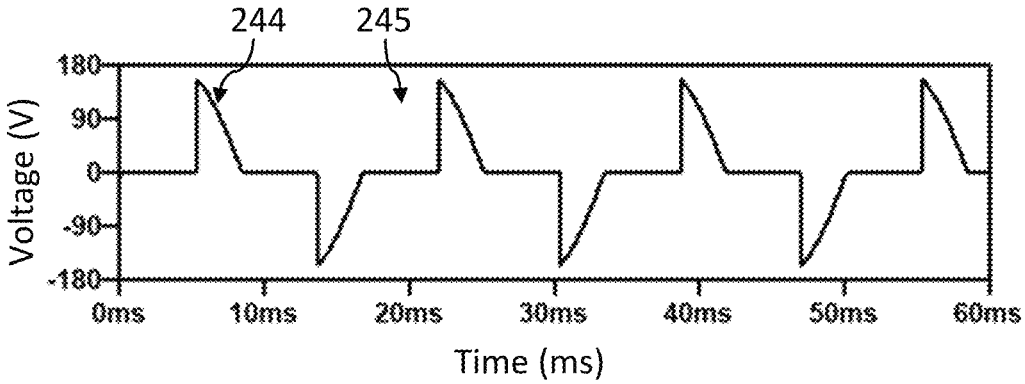

FIG. 5 shows a voltage waveform of the mains power. In the two-load implementation 200 of FIG. 2, this is the voltage waveform of first mains power 232 and second mains power 242. In the example shown, the RMS voltage is 120 V and the frequency is 60 Hz. FIGS. 6, 7, 8, 9, 10, 11, 12, 13, and 14 show example waveforms for the two-load implementation 200 when the power apportionment according to Equations 1, 2, 3, and 4 are carried out. In this example, the first power setting value $S_1$ is 80% and the second power setting value $S_2$ is 40%. FIG. 6 shows a voltage waveform of the first phase-cut signal 234, including a phase-cut portion 235 at the start of each half-cycle. Approximately 20% of the phase has been cut from the original AC waveform 232. FIG. 7 shows a voltage waveform of the second phase-cut signal 244, including a phase-cut portion 245 at the start of each half-cycle. Approximately 60% of the phase has been cut from the original waveform 242.

Figure 8:
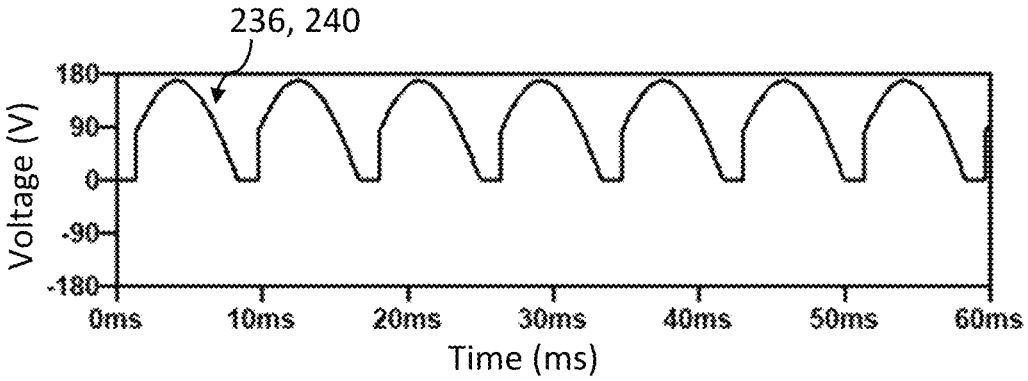
FIGS. 8 and 9 are graphical plots of phase-cut rectified signals.
Figure 9:
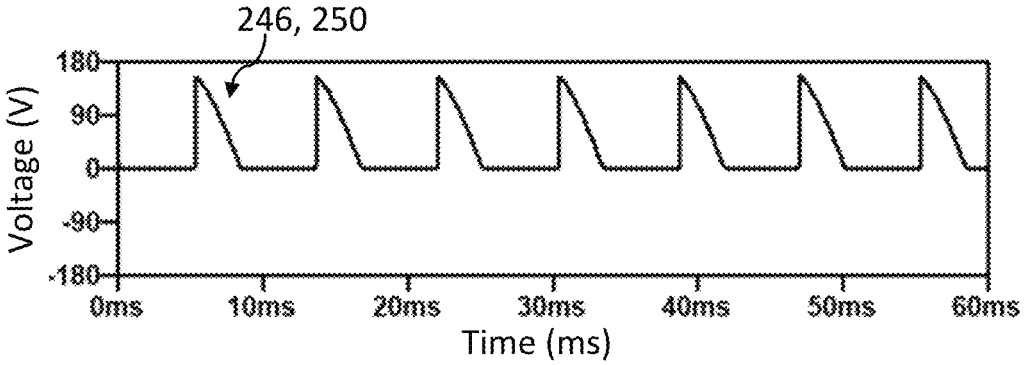
Figure 10:
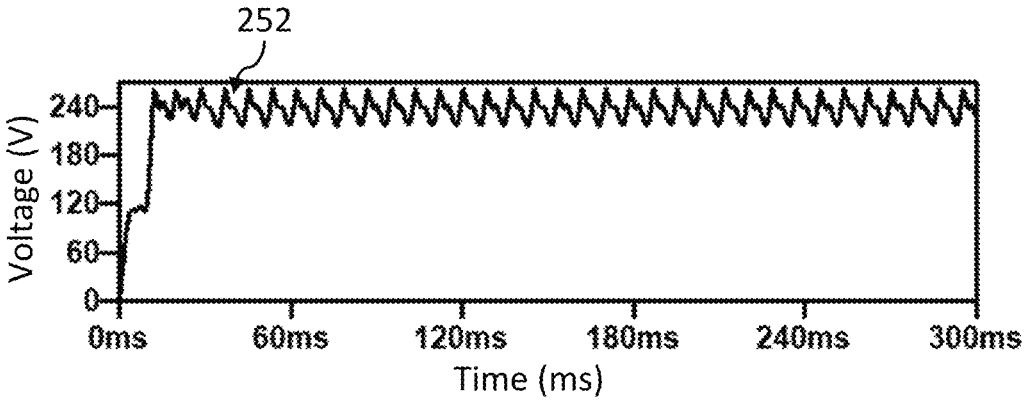
FIG. 10 is a graphical plot of a power-factor corrected output from a power factor correction (PFC) stage.
Figure 11:
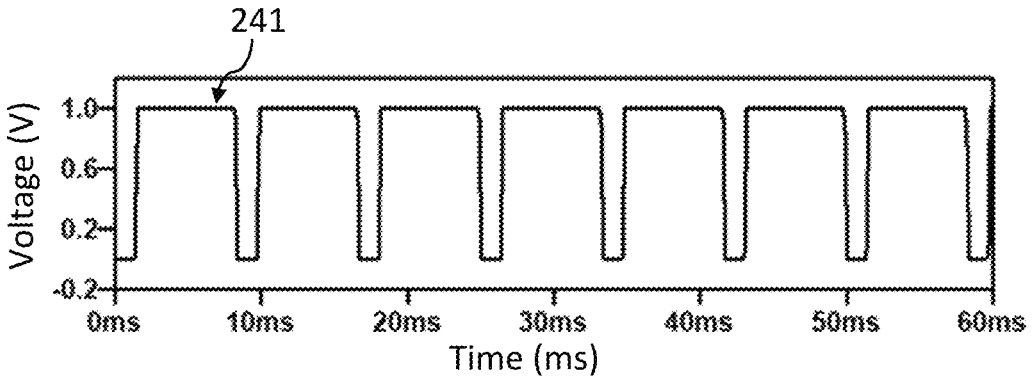
FIGS. 11 and 12 are graphical plots of pulse-width modulation (PWM) signals.
Figure 12:
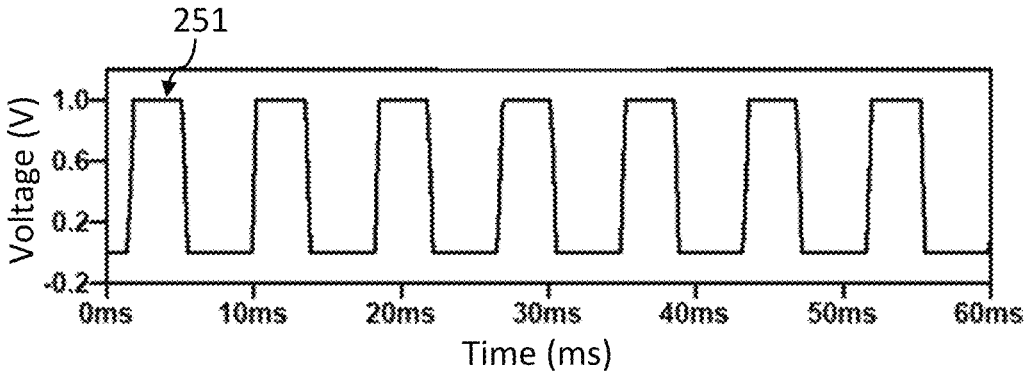

FIG. 8 shows a voltage waveform of the first phase-cut rectified power signal 236 and the first phase-cut derived signal 240. Approximately 20% of the phase has been cut from the original AC waveform. FIG. 9 shows a voltage waveform of the second phase-cut rectified power signal 246 and the first phase-cut derived signal 250. Approximately 60% of the phase has been cut from the original AC waveform. A sum 256 of the first phase-cut rectified power signal 236 and the second phase-cut rectified power signal 246 is received by the PFC stage 222 as input (via the Adder 270). FIG. 10 shows a voltage waveform of a power-factor corrected electrical power 252. After initial transients have dissipated, the voltage waveform approximates a DC waveform around 240 V.

The microcontroller 224 is configured to receive a first phase-cut derived signal 240 and a second phase-cut derived signal 250 as inputs (at the respective input pins of the MCU). The MCU 224 determines a first internal PWM signal 241 (FIG. 11) from the first phase-cut derived signal 240 and a second internal PWM signal 251 (FIG. 12) from the second phase-cut derived signal 250. For each phase-cut derived signal (240, 250), the respective internal PWM signals (241, 251) are determined as follows: the voltage level of the internal PWM signal is set at logical LOW (0.0 V in this example) when the phase-cut signal (voltage at the respective input pin) is at 0 V and the voltage level of the internal PWM signal is set at logical HIGH (1.0 V in this example) when the phase-cut signal (voltage at the respective input pin) is greater than 0 V. Accordingly, the first internal PWM signal 241 (FIG. 11) has a duty cycle of approximately 80% (phase cut of approximately 20%, as shown by waveforms 234 and 236) and the second internal PWM signal 251 (FIG. 12) has a duty cycle of approximately 40% (phase cut of approximately 60%, as shown by waveforms 244 and 246). In this example, the first power setting value $S_1$ is approximately 80% and the second power setting value $S_2$ is approximately 40%. The MCU 224 calculates the output portions $P_1$ and $P_2$ in accordance with Equations 1, 2, 3, and 4. In this example, the first output portion $P_1$ and second output portion $P_2$ are calculated to be approximately 66.7% and 33.3%, respectively. In this example, the MCU 224 outputs a first PWM control signal 254, having a duty cycle of approximately 66.7%, to the first flyback input circuit 208A and a second PWM control signal 264, having a duty cycle of approximately 33.3%, to the second flyback input circuit 218A.

Figure 13:
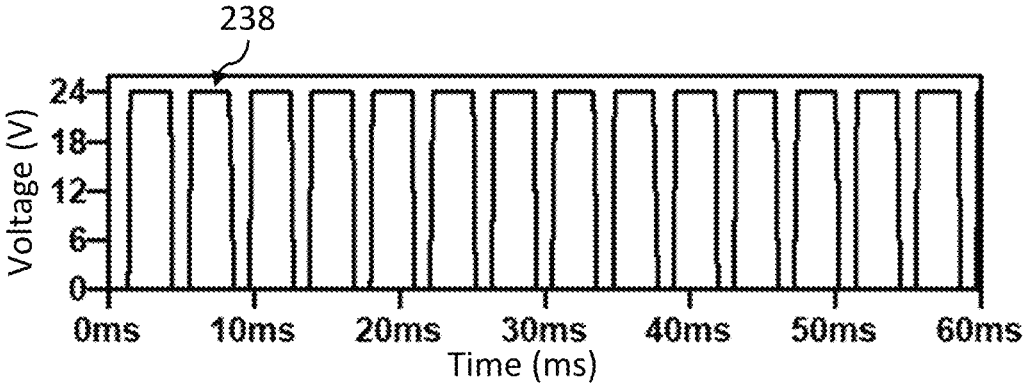
FIGS. 13 and 14 are graphical plots of power output from the flyback converters to the respective loads.

FIG. 13 shows a waveform of the first power output 238 supplied by first flyback output circuit 208B to the first load 210. In the example shown, the first flyback output circuit 208B has an output voltage ranging between 0 V and 24 V and the maximum power output is approximately 96 W (48 W×2). The waveform of the first power output 238 has a duty cycle of approximately 66.7%. Accordingly, the first flyback output circuit 208B supplies approximately 66.7% of 96 W to the first load 210.

Figure 14:
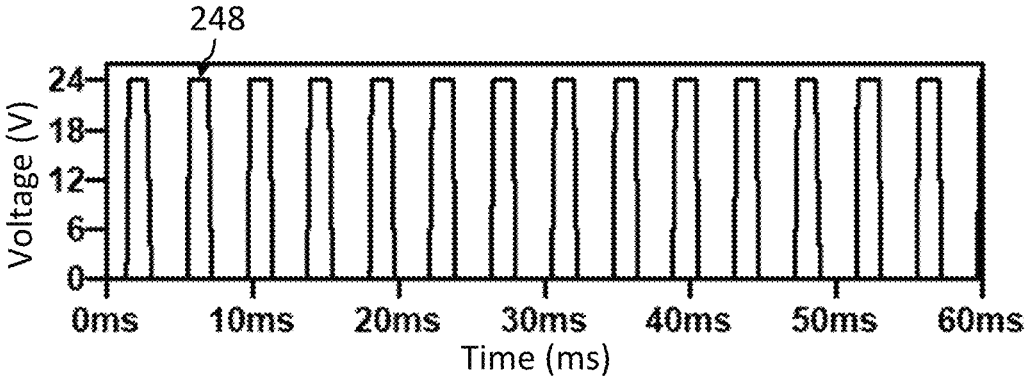

FIG. 14 shows a waveform of the second power output 248 supplied by second flyback output circuit 218B to the second load 220. In the example shown, the second flyback output circuit 218B has an output voltage ranging between 0 V and 24 V and the maximum power output is approximately 96 W (48 W×2). The waveform of the second power output 248 has a duty cycle of approximately 33.3%. Accordingly, the second flyback output circuit 218B supplies approximately 33.3% of 96 W to the second load 220.

There are some useful applications for dimmable solid-state light sources in which there are two mains power sources and two loads. In a first example, a dimmable solid-state light source is used for concurrently providing light for two applications in a room. Suppose that a first solid-state light emitter is configured for task lighting and a second solid-state light emitter is configured for ambient lighting. By adjusting the power output portions $P_1$ and $P_2$, a user can increase the brightness of one of the light emitters to greater than 100% with a corresponding reduction in the brightness of the other of the light emitters. In a second example, a first solid-state light emitter emits white light of a first color temperature $T_1$ and the second solid-state light emitter emits a white light of a second color temperature $T_2$ different from $T_1$. Suppose that the light emitted by the solid-sate light emitters are mixed before reaching the illumination area. By adjusting the power output portions $P_1$ and $P_2$, white light of a range of color temperatures between $T_1$ and $T_2$ can be achieved. In a third example, a first solid-state light emitter emits white light and the second solid-state light emitter emits red light. Suppose that the light emitted by the solid-sate light emitters are mixed before reaching the illumination area. By adjusting the power output portions $P_1$ and $P_2$, white light with a range red content can be achieved.

Figure 3:
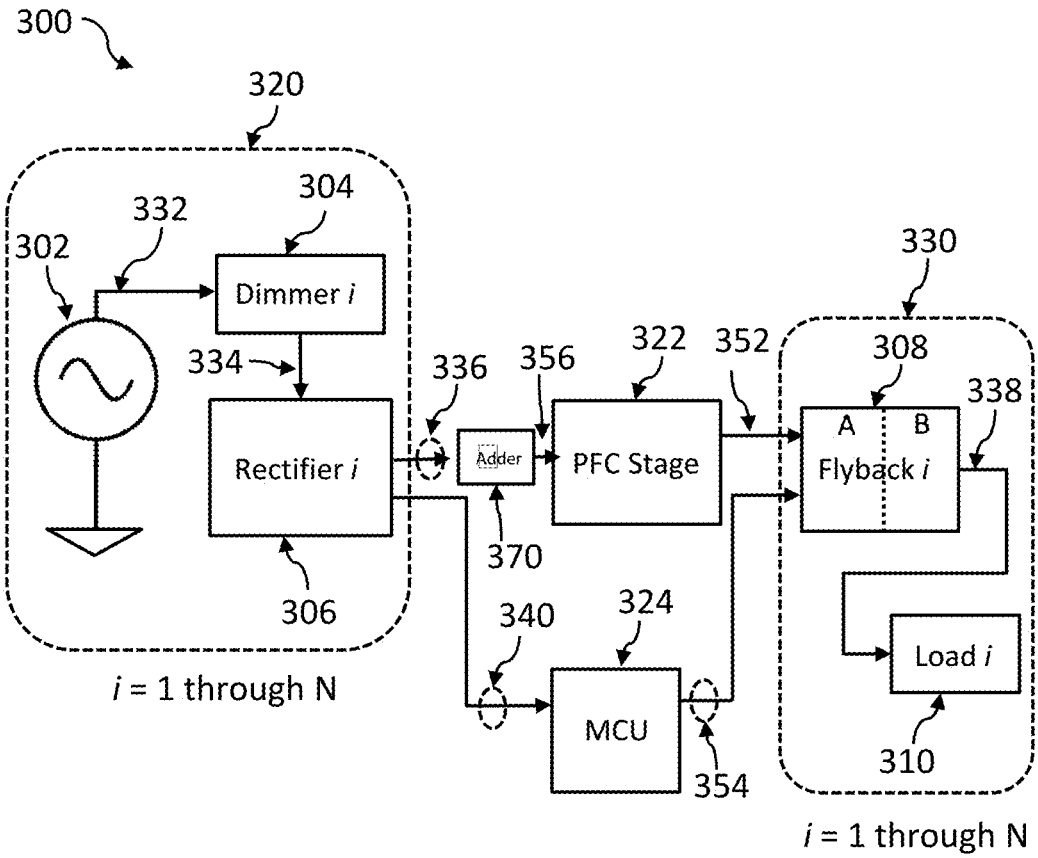
FIG. 3 is a schematic block diagram of an implementation of a dimmable solid-state light source including a plurality of loads.

FIG. 2 shows an implementation 200 of a dimmable solid-state light source and a solid-state light emitter power supply in which there are two loads. The concepts illustrated in FIG. 2 can be extended to implementations having more than two loads. FIG. 3 is a schematic block diagram of an implementation 300 of a dimmable solid-state light source including a plurality of loads, numbered 1 through N. Each load includes a respective solid-state light emitter.

The implementation 300 includes a plurality of mains power sources 302 (numbered 1 through N), a plurality of dimmer circuits 304 (numbered 1 through N), and a plurality of rectifier circuits (numbered 1 through N). Each mains power source 302 supplies a respective mains power 332 to a respective dimmer circuit 304. Each dimmer circuit 304 is configured to: receive the respective mains power 332, receive a respective dimming input, and output a respective phase-cut signal 334 in accordance with the respective dimming input. Each rectifier circuit 306 is couplable to the respective dimmer circuit 304. Each rectifier circuit 306 is configured to receive a respective phase-cut signal 334 from the respective dimmer circuit 304 as input and output a respective phase-cut rectified power signal 336.

A power factor correction (PFC) stage 322 is coupled to the rectifier circuits 306. The PFC stage 322 is configured to receive a sum 356 (via Adder 370) of the respective phase-cut rectified power signals 336 as input and output a power-factor corrected electrical power 352. There is a plurality of flyback converters 308 (numbered 1 through N). Each respective flyback converter 308 includes a respective flyback input circuit 308A and a respective flyback output circuit 308B. Each respective flyback input circuit 308A is coupled to the PFC stage 322. The flyback input circuits 308A are connected to the PFC stage 322 in parallel. Each respective flyback output circuit 308B is configured to supply a respective power output 338. Each respective flyback output circuit 308B is configured to power a respective load 310 including a respective solid-state light emitter.

A microcontroller 324 is configured to receive respective phase-cut derived signals 340 as inputs. Each respective phase-cut derived signal 340 is derived from the respective phase-cut signal 334. The microcontroller 324 calculates respective power output portions $P_i$, (i ranges from 1 through N) in accordance with the phase-cut derived signals 340. The microcontroller 324 is configured to output a respective pulse-width modulation (PWM) control signal 354 to each respective flyback input circuit 308A in accordance with the respective power output portion $P_i$. Each respective flyback input circuit 308A receives the respective power output portion $P_i$(i ranges from 1 through N) of the power-factor corrected electrical power 352 in accordance with the respective PWM control signal 354.

For ease of illustration, one instance i of a diagram portion 320, including foregoing elements 302 (mains power source), 304 (dimmer circuit), 306 (rectifier circuit), 332 (mains power), 334 (phase-cut signal), 336 (phase-cut rectified power signal), and 340 (phase-cut derived signal), is shown. The implementation 300 includes N instances of diagram portion 320. Similarly, for ease of illustration, one instance i of a diagram portion 330, including foregoing elements 308 (flyback converter), 310 (load), 338 (power output to load), and 354 (PWM control signal), is shown. The implementation 300 includes N instances of diagram portion 330.

There are some useful applications for dimmable solid-state light sources in which the number N is 3 (e.g., 3 instances each of: mains power sources, dimmer circuits, rectifier circuits, flyback converters, loads, and solid-state light emitters). In a fourth example, a first solid-state light emitter emits red light, a second solid-state light emitter emits green light, and a third solid-state light emitter emits blue light. Suppose that the light emitted by the solid-sate light emitters are mixed before reaching the illumination area. By adjusting the power output portions $P_1$, $P_2$, and $P_3$, a wide range of colors including white can be produced. In a fifth example, a first solid-state light emitter emits a first non-white color, the second solid-state light emitter emits a second non-white color, and the third solid-state light emitter emits white light. Suppose that the light emitted by the solid-state light emitters are mixed before reaching the illumination area. By adjusting the power output portions $P_1$, $P_2$, and $P_3$, a range of colors including (1) white, (2) white with the first non-white color (e.g., red) added, and (3) white with the second non-white color (e.g., blue) added can be produced.

There are some useful applications for dimmable solid-state light sources in which the number N is 4. In a sixth example, a first solid-state light emitter emits red light, a second solid-state light emitter emits green light, a third solid-state light emitter emits blue light, and a fourth solid-state light emitter emits white light. Suppose that the light emitted by the solid-sate light emitters are mixed before reaching the illumination area. By adjusting the power output portions $P_1$, $P_2$, $P_3$, and $P_4$, a wide range of colors including white can be produced. This differs from the foregoing fourth example in that a purer white can be achieved.

Figure 15:
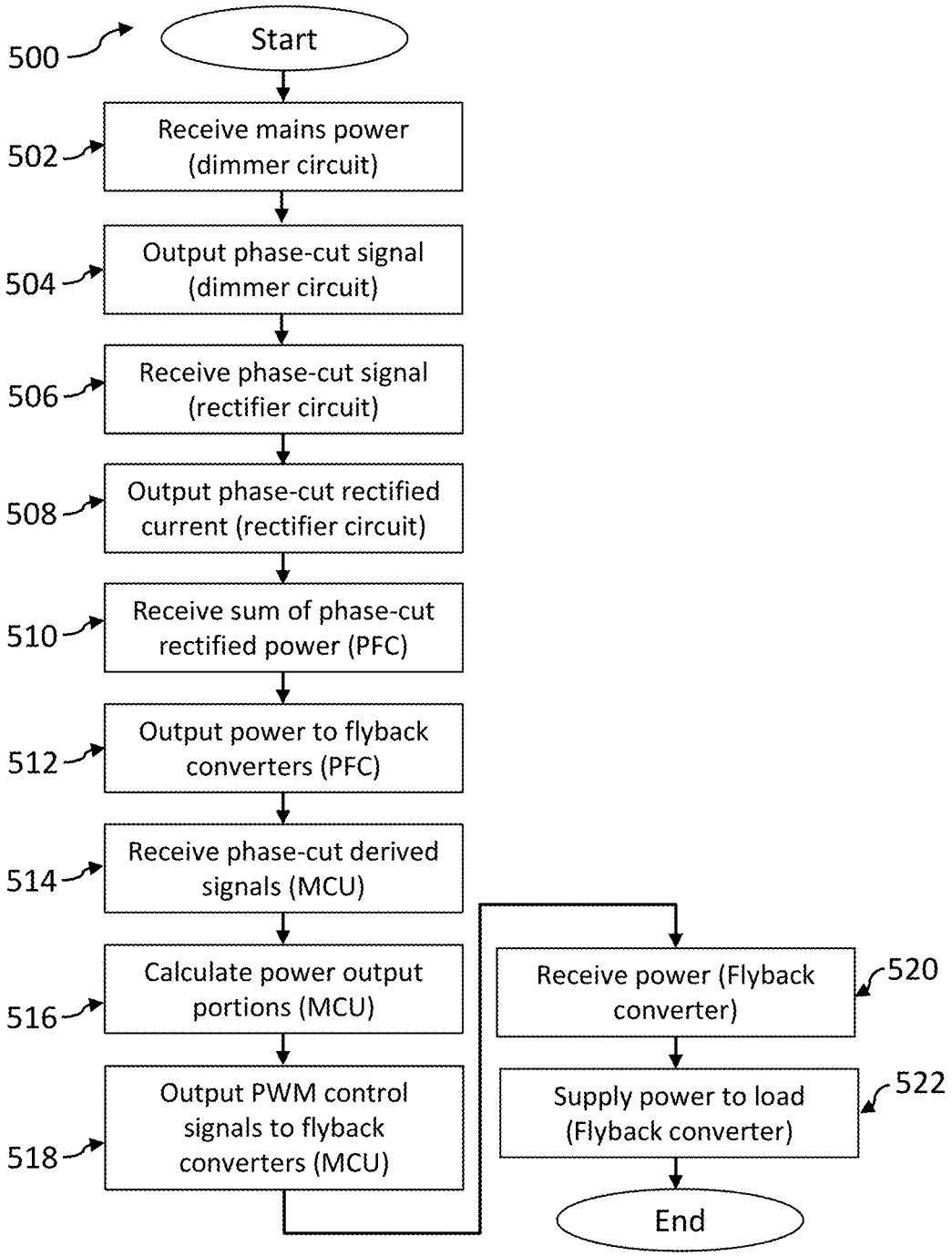
FIG. 15 is a flow diagram of a method of powering solid-state light emitters.

FIG. 15 is a flow diagram of a method 500 of powering solid-state light emitters. The method 500 can be carried out, for example, using the implementation 300 of multiple loads (numbering N) shown in FIG. 3, and the method 500 described below will be discussed in the context of the implementation 300. Further, in some cases the Method 500 can be carried out, for example, using the implementation 200 of two loads shown in FIG. 2. Method 500 includes steps 502, 504, 506, 508, 510, 512, 514, 516, 518, 520, and 522. At step 502, each one of a plurality of dimmer circuits 304 (numbered 1 through N) receives a respective mains power 332 and a respective dimming input. At step 504, each respective dimmer circuit 304 outputs a respective phase-cut signal 334 in accordance with the respective dimming input. At step 506, each one of a plurality of rectifier circuits 306 (numbered 1 through N) receives the respective phase-cut signal 334 from the respective dimmer circuit 304 as input. At step 508, each respective rectifier circuit 306 outputs a respective phase-cut rectified power signal 336.

A power factor correction (PFC) stage 322 is coupled to the rectifier circuits 306. At step 510, the PFC stage receives a sum 356 (via Adder 370) of the phase-cut rectified power signals 336 as input. At step 512, the PFC stage 322 outputs a power-factor corrected electrical power 352 to a plurality of flyback converters 308 (numbered 1 through N). Each respective flyback converter 308 includes a respective flyback input circuit 308A and a respective flyback output circuit 308B. Each respective flyback input circuit 308A is coupled to the PFC stage 322 and each respective flyback output circuit 308B is coupled to a respective load 310 which includes a respective solid-state light emitter. The flyback input circuits 308A are connected to the PFC stage 322 in parallel.

At step 514, microcontroller 324 receives respective phase-cut derived signals 340 as inputs. Each respective phase-cut derived signal 340 is derived from the respective phase-cut signal 334. At step 516, the microcontroller 324 calculates each power output portion $P_i$, (i ranges from 1 through N) in accordance with the phase-cut derived signals 340. At step 518, the microcontroller 324 outputs a respective pulse-width modulation (PWM) control signal 354 to each respective flyback input circuit in accordance with the respective power output portion $P_i$.

At step 520, each respective flyback input circuit 308A receives the respective portion $P_i$ of the power-factor corrected electrical power 352 in accordance with the respective PWM control signal 354. At step 522, each respective flyback output circuit 308B powers the respective load 310.

What is claimed is:

1. A solid-state light emitter power supply, comprising:

a first rectifier circuit couplable to a first dimmer circuit and configured to receive a first phase-cut signal from the first dimmer circuit as input and output a first phase-cut rectified power signal;

a second rectifier circuit couplable to a second dimmer circuit and configured to receive a second phase-cut signal from the second dimmer circuit as input and output a second phase-cut rectified power signal;

a power factor correction (PFC) stage coupled to the first rectifier circuit and to the second rectifier circuit and configured to receive a sum of the first phase-cut rectified power signal and the second phase-cut rectified power signal as input and output a power-factor corrected electrical power;

a first flyback converter comprising a first flyback input circuit and a first flyback output circuit, the first flyback input circuit being coupled to the PFC stage and the first flyback output circuit being configured to power a first load comprising a first solid-state light emitter;

a second flyback converter comprising a second flyback input circuit and a second flyback output circuit, the second flyback input circuit being coupled to the PFC stage and the second flyback output circuit being configured to power a second load comprising a second solid-state light emitter, the first flyback input circuit and the second flyback input circuit being connected to the PFC stage in parallel; and a microcontroller configured to receive a first phase-cut derived signal, which is derived from the first phase-cut signal, and a second phase-cut derived signal, which is derived from the second phase-cut signal, as inputs and to output a first pulse-width modulation (PWM) control signal to the first flyback input circuit in accordance with a first power output portion $P_1$ and a second PWM control signal to the second flyback input circuit in accordance with a second output portion $P_2$;

wherein the first flyback input circuit receives the first power output portion $P_1$ of the power-factor corrected electrical power in accordance with the first PWM control signal and the second flyback input circuit receives the second output portion $P_2$ of the power-factor corrected electrical power in accordance with the second PWM control signal; and the microcontroller calculates the first power output portion $P_1$ and the second power output portion $P_2$ in accordance with the first phase-cut derived signal and the second phase-cut derived signal.

2. The solid-state light emitter power supply of claim 1, wherein:

the first dimmer circuit is configured to: receive a first mains power, receive a first dimming input, and output a first phase-cut signal in accordance with the first dimming input; and the second dimmer circuit is configured to receive a second mains power, receive a second dimming input, and output a second phase-cut signal in accordance with the second dimming input.

3. The solid-state light emitter power supply of claim 1, wherein the first phase-cut derived signal indicates a first power setting value $S_1$, the second phase-cut derived signal indicates a second power setting value $S_2$, and $S_1$, $S_2$, $P_1$, and $P_2$ are related as follows:

$$P_1=S_1 \text{ when a sum } S_1+S_2<100\% \quad (1);$$

$$P_2=S_2 \text{ when the sum } S_1+S_2<100\% \quad (2);$$

$$P_1=\frac{S_1}{S_1+S_2},$$

when the sum $S_1+S_2\geq 100\%$ (Eq. 3); and $$P_2=\frac{S_2}{S_1+S_2},$$

when the sum $S_1+S_2\geq 100\%$ (Eq. 4).

4. The solid-state light emitter power supply of claim 1, further comprising the first dimmer circuit and the second dimmer circuit.

5. The solid-state light emitter power supply of claim 1, wherein the first phase-cut derived signal corresponds to a first voltage signal proportional to the first phase-cut rectified power signal and the second phase-cut derived signal corresponds to a second voltage signal proportional to the second phase-cut rectified power signal.

6. A dimmable solid-state light source, comprising:

a first load comprising a first solid-state light emitter;

a second load comprising a second solid-state light emitter;

a first rectifier circuit couplable to a first dimmer circuit and configured to receive a first phase-cut signal from the first dimmer circuit as input and output a first phase-cut rectified power signal;

a second rectifier circuit couplable to a second dimmer circuit and configured to receive a second phase-cut signal from the second dimmer circuit as input and output a second phase-cut rectified power signal;

a power factor correction (PFC) stage coupled to the first rectifier circuit and to the second rectifier circuit and configured to receive a sum of the first phase-cut rectified power signal and the second phase-cut rectified power signal as input and output a power-factor corrected electrical power;

a first flyback converter comprising a first flyback input circuit and a first flyback output circuit, the first flyback input circuit being coupled to the PFC stage and the first flyback output circuit being configured to power the first load;

a second flyback converter comprising a second flyback input circuit and a second flyback output circuit, the second flyback input circuit being coupled to the PFC stage and the second flyback output circuit configured to power the second load, the first flyback input circuit and the second flyback input circuit being connected to the PFC stage in parallel; and a microcontroller configured to receive a first phase-cut derived signal, which is derived from the first phase-cut signal, and a second phase-cut derived signal, which is derived from the second phase-cut signal, as inputs and to output a first pulse-width modulation (PWM) control signal to the first flyback input circuit in accordance with a first power output portion $P_1$ and a second PWM control signal to the second flyback input circuit in accordance with a second output portion $P_2$;

wherein the first flyback input circuit receives the first power output portion $P_1$ of the power-factor corrected electrical power in accordance with the first PWM control signal and the second flyback input circuit receives the second output portion $P_2$ of the power-factor corrected electrical power in accordance with the second PWM control signal; and the microcontroller calculates the first power output portion $P_1$ and the second power output portion $P_2$ in accordance with the first phase-cut derived signal and the second phase-cut derived signal.

7. The dimmable solid-state light source of claim 6, wherein:

the first dimmer circuit is configured to: receive a first mains power, receive a dimming input, and output a first phase-cut signal in accordance with the first dimming input; and the second dimmer circuit is configured to receive a second mains power, receive a second dimming input, and output a second phase-cut signal in accordance with the second dimming input.

8. The dimmable solid-state light source of claim 6, wherein the first phase-cut derived signal indicates a first power setting value $S_1$, the second phase-cut derived signal indicates a second power setting value $S_2$, and $S_1$, $S_2$, $P_1$, and $P_2$ are related as follows:

$$P_1=S_1 \text{ when a sum } S_1+S_2<100\% \quad (1);$$

$$P_2=S_2 \text{ when the sum } S_1+S_2<100\% \quad (2);$$

$$P_1=\frac{S_1}{S_1+S_2},$$

when the sum $S_1+S_2\geq 100\%$ (Eq. 3); and $$P_2=\frac{S_2}{S_1+S_2},$$

when the sum $S_1+S_2\geq 100\%$ (Eq. 4).

9. The dimmable solid-state light source of claim 6, additionally comprising the first dimmer circuit and the second dimmer circuit.

10. The dimmable solid-state light source of claim 6, wherein the first phase-cut derived signal corresponds to a first voltage signal proportional to the first phase-cut rectified power signal and the second phase-cut derived signal corresponds to a second voltage signal proportional to the second phase-cut rectified power signal.

11. The dimmable solid-state light source of claim 6, wherein the first solid-state light emitter emits white light and the second solid-state light emitter emits red light.

12. The dimmable solid-state light source of claim 6, wherein the first solid-state light emitter and the second solid-state light emitter emit white light of different color temperatures.

13. A solid-state light emitter power supply, comprising:

a plurality of rectifier circuits, each couplable to a respective dimmer circuit and configured to receive a respective phase-cut signal from the respective dimmer circuit as input and output a respective phase-cut rectified power signal;

a power factor correction (PFC) stage coupled to the rectifier circuits and configured to receive a sum of the respective phase-cut rectified power signals as input and output a power-factor corrected electrical power;

a plurality of flyback converters, each respective flyback converter comprising a respective flyback input circuit and a respective flyback output circuit, each respective flyback input circuit being coupled to the PFC stage and each respective flyback output circuit being configured to power a respective load comprising a respective solid-state light emitter, the flyback input circuits being connected to the PFC stage in parallel; and a microcontroller configured to receive respective phase-cut derived signals as inputs, each of which is derived from the respective phase-cut signal, and to output a respective pulse-width modulation (PWM) control signal to each respective flyback input circuit in accordance with a respective power output portion $P_i$ wherein i ranges from 1 through N and wherein i and N are positive integers;

wherein each respective flyback input circuit receives the respective power output portion $P_i$ of the power-factor corrected electrical power in accordance with the respective PWM control signal; and the microcontroller calculates the respective power output portions $P_i$ in accordance with the phase-cut derived signals.

14. The solid-state light emitter power supply of claim 13, wherein:

each respective dimmer circuit is configured to: receive a respective mains power, receive a respective dimming input, and output a respective phase-cut signal in accordance with the respective dimming input.

15. The solid-state light emitter power supply of claim 13, further comprising the respective dimmer circuits.

16. A dimmable solid-state light source, comprising:

a plurality of loads, each one of the loads comprising a respective solid-state light emitter;

a plurality of rectifier circuits, each couplable to a respective dimmer circuit and configured to receive a respective phase-cut signal from the respective dimmer circuit as input and output a respective phase-cut rectified power signal;

a power factor correction (PFC) stage coupled to the plurality of rectifier circuits and configured to receive a sum of the respective phase-cut rectified power signals as input and output a power-factor corrected electrical power;

a plurality of flyback converters, each respective flyback converter comprising a respective flyback input circuit and a respective flyback output circuit, each respective flyback input circuit being coupled to the PFC stage and each respective flyback output circuit being configured to power a respective one of the loads, the flyback input circuits being connected to the PFC stage in parallel; and a microcontroller configured to receive respective phase-cut derived signals as inputs, each of which is derived from the respective phase-cut signal, and to output a respective pulse-width modulation (PWM) control signal to each respective flyback input circuit in accordance with a respective power output portion $P_i$ wherein i ranges from 1 through N and wherein i and N are positive integers;

wherein each respective flyback input circuit receives the respective power output portion $P_i$ of the power-factor corrected electrical power in accordance with the respective PWM control signal; and the microcontroller calculates the respective power output portions $P_i$ in accordance with the phase-cut derived signals.

17. The dimmable solid-state light source of claim 16, wherein:

each respective dimmer circuit is configured to: receive a respective mains power, receive a respective dimming input, and output a respective phase-cut signal in accordance with the respective dimming input.

18. The dimmable solid-state light source of claim 16, further comprising the respective dimmer circuits.

19. The dimmable solid-state light source of claim 16, wherein the number N is 3 and the first solid-state light emitter emits red light, the second solid-state light emitter emits green light, and the third solid-state light emitter emits blue light.

20. The dimmable solid-state light source of claim 16, wherein the number N is 3 and the first solid-state light emitter emits a first non-white color, the second solid-state light emitter emits a second non-white color, and the third solid-state light emitter emits white light.

21. The dimmable solid-state light source of claim 16, wherein the number N is 4 and the first solid-state light emitter emits red light, the second solid-state light emitter emits green light, the third solid-state light emitter emits blue light, and the fourth solid-state light emitter emits white light.

22. A method of powering solid-state light emitters, comprising the steps of:

receiving, by each one of a plurality of rectifier circuits, a respective phase-cut signal from a respective dimmer circuit as input;

outputting, by each respective rectifier circuit, a respective phase-cut rectified power signal;

receiving, by a power factor correction (PFC) stage coupled to the rectifier circuits, a sum of the phase-cut rectified power signals as input;

outputting, by the PFC stage, a power-factor corrected electrical power to a plurality of flyback converters, each respective flyback converter comprising a respective flyback input circuit and a respective flyback output circuit, each respective flyback input circuit being coupled to the PFC stage and each respective flyback output circuit coupled to a respective load comprising a respective solid-state light emitter, the flyback input circuits being connected to the PFC stage in parallel;

receiving, by a microcontroller, respective phase-cut derived signals as inputs, each of which is derived from the respective phase-cut signal;

calculating, by the microcontroller, each power output portion $P_i$ wherein i ranges from 1 through N and wherein i and N are positive integers in accordance with the phase-cut derived signals;

outputting, by the microcontroller, a respective pulse-width modulation (PWM) control signal to each respective flyback input circuit in accordance with the respective power output portion $P_i$;

receiving, by each respective flyback input circuit, the respective portion $P_i$ of the power-factor corrected electrical power in accordance with the respective PWM control signal; and powering, by each respective flyback output circuit, the respective load.

23. The method of claim 22, additionally comprising the steps of:

receiving, by each respective dimmer circuit, a respective mains power and a respective dimming input; and outputting, by each respective dimmer circuit, the respective phase-cut signal in accordance with the respective dimming input.

24. The method of claim 22, wherein the number N is 2, the first phase-cut derived signal indicates a first power setting value $S_1$, the second phase-cut derived signal indicates a second power setting value $S_2$, and $S_1$, $S_2$, $P_1$, and $P_2$ are related as follows:

$$P_1=S_1 \text{ when a sum } S_1+S_2<100\% \quad (1);$$

$$P_2=S_2 \text{ when the sum } S_1+S_2<100\% \quad (2);$$

$$P_1 = \frac{S_1}{S_1 + S_2},$$

when the sum $S_1+S_2 \geq 100\%$ (Eq. 3); and $$P_2 = \frac{S_2}{S_1 + S_2},$$

when the sum $S_1+S_2 \geq 100\%$ (Eq. 4).

25. The method of claim 22, wherein each respective phase-cut derived signal corresponds to a respective voltage signal proportional to the respective phase-cut rectified power signal.

* * * * *